US007674060B2

(12) United States Patent
Lucero

(10) Patent No.: US 7,674,060 B2
(45) Date of Patent: Mar. 9, 2010

(54) WINDOW CLEANING DEVICE FOR OUT OF REACH WINDOWS

(76) Inventor: Lawrence Lucero, 7315 Dover St., Arvada, CO (US) 80005

( * ) Notice: Subject to any disclaimer, the term of this patent is extended or adjusted under 35 U.S.C. 154(b) by 272 days.

(21) Appl. No.: 12/380,896

(22) Filed: Nov. 28, 2007

(65) Prior Publication Data

US 2009/0282632 A1 Nov. 19, 2009

(51) Int. Cl.
*A46B 11/00* (2006.01)

(52) U.S. Cl. ..... 401/123; 401/48; 401/118; 401/140

(58) Field of Classification Search ..... 401/188 R, 401/48, 140, 118, 123; 15/98; 222/174, 222/180

See application file for complete search history.

(56) References Cited

U.S. PATENT DOCUMENTS 3,017,056 A * 1/1962 Bishop ..... 222/164
3,856,209 A * 12/1974 Hickson ..... 239/532
4,432,472 A * 2/1984 Lamm ..... 222/174
6,227,740 B1 * 5/2001 Stear et al. ..... 401/188 R
6,789,705 B2 * 9/2004 Drew ..... 222/174
6,966,461 B2 * 11/2005 Warner et al. ..... 222/174
7,040,510 B1 * 5/2006 Hester ..... 222/174
7,267,503 B1 * 9/2007 Bentsen ..... 401/123
2009/0097901 A1 * 4/2009 McCarthy ..... 401/138

* cited by examiner

*Primary Examiner*—David J Walczak

(57) ABSTRACT

A device for cleaning an out of reach window of a structure, which window might be otherwise difficult to reach without utilizing a ladder, wherein the apparatus comprises: a) a receptacle for holding a spray bottle containing window cleaning fluid; b) an armature to which can be attached a cable enabling the user to pull the cable thereby compressing the handle of the spray bottle and spraying cleaning fluid onto the window; c) a device for holding paper towels, fabric or other material for cleaning and drying the window; d) a receptacle for receiving a fixed or extending pole, enabling the user to extend the device above his head and clean windows which are otherwise out of reach.

5 Claims, 4 Drawing Sheets

WINDOW CLEANING DEVICE FOR OUT OF REACH WINDOWS

CROSS REFERENCE TO RELATED APPLICATIONS

N/A

STATEMENT OF FEDERALLY SPONSORED RESEARCH/DEVELOPMENTS

N/A

REFERENCE TO SEQUENCE LISTING

N/A

BACKGROUND OF THE INVENTION

For years I have had trouble cleaning windows that are high and out of reach because they are not accessible without a ladder. Devices are available on the market but they consist of wetting devices and squeegees which are not practical because they leave too much water on the window sills and tend to wet the walls below. The proposed device should alleviate those problems.

BRIEF SUMMARY OF THE INVENTION

A device to facilitate the cleaning of windows that are out of reach.

BRIEF DESCRIPTION OF THE INVENTION

A device to be attached to an extending pole which is typically available in home supply stores and other retail outlets, and which is commonly used for painting high walls, changing light bulbs which are out of reach, etc. The device is to be constructed of molded plastic, and is to hold a typical window cleaner spray bottle that can be activated by pulling a cord even when high above the operator. The device also includes a pad to which can be attached paper towels or other materials for drying windows after being sprayed with window cleaning fluid.

DETAILED DESCRIPTION OF THE INVENTION

Figure 1:
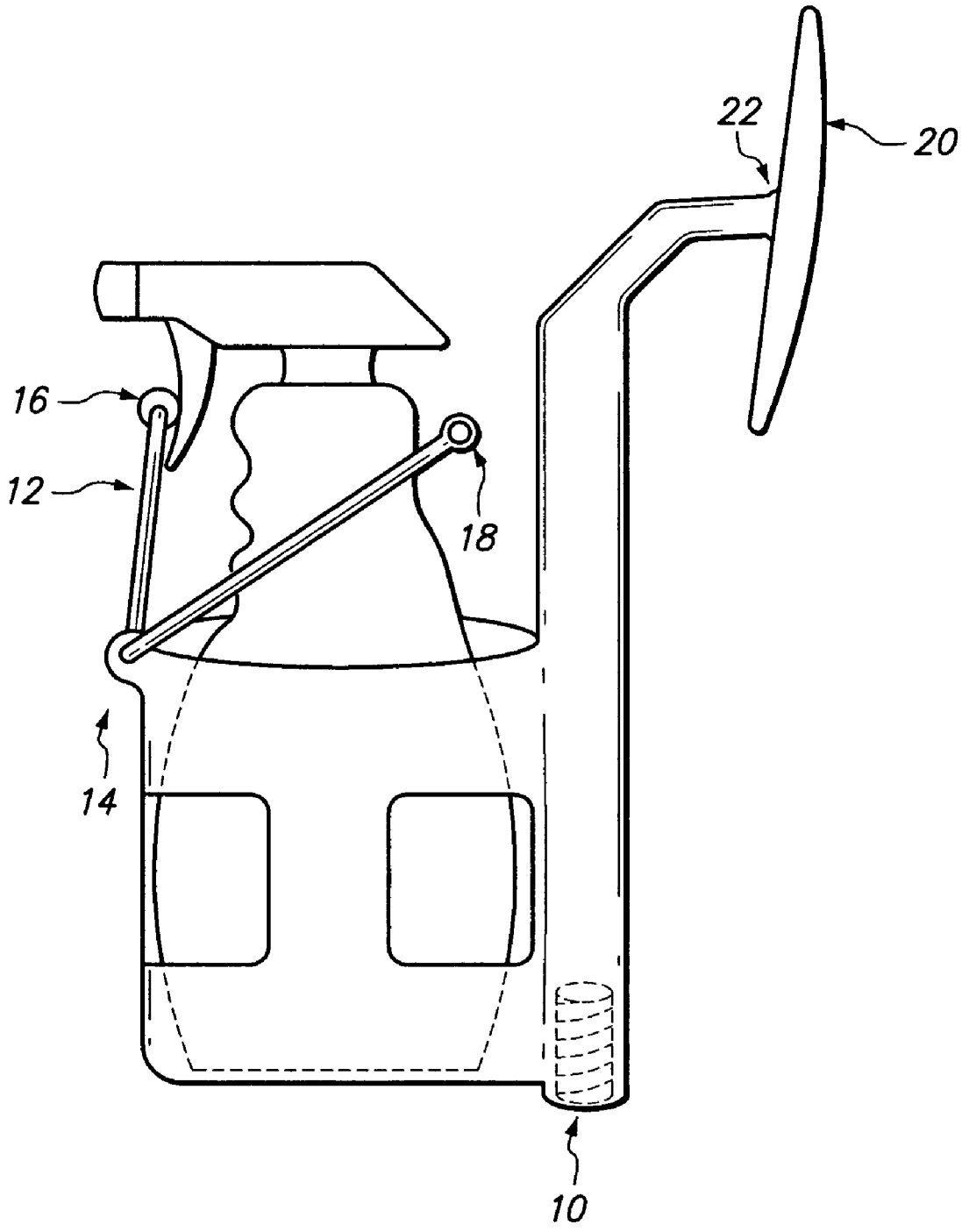
FIG. 1 shows a side view of the window cleaning device having a spray bottle therein.
Figure 2:
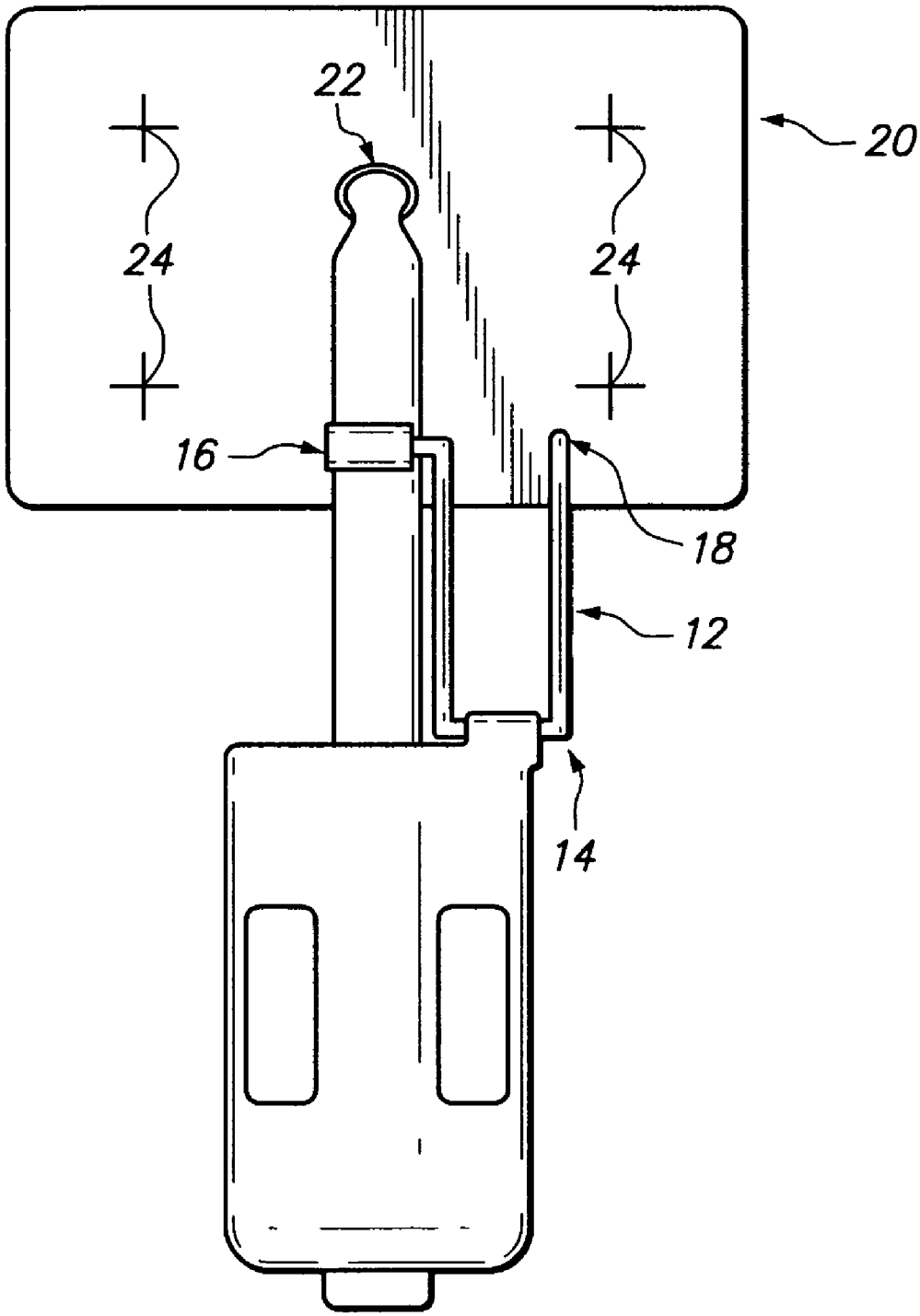
FIG. 2 shows a front view of the device without the removable spray bottle.
Figure 3:
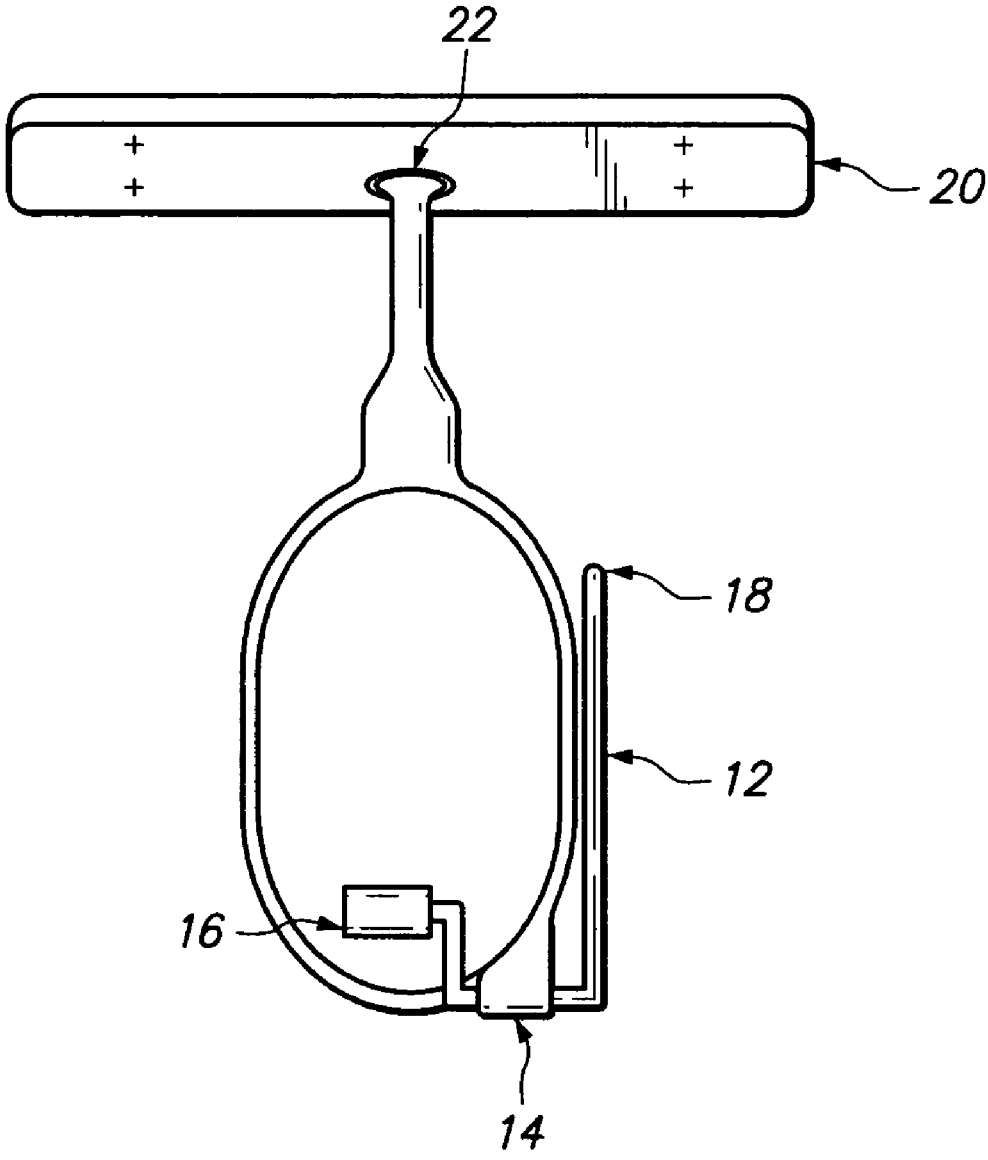
FIG. 3 shows a top view of the device without the removable spray bottle.
Figure 4:
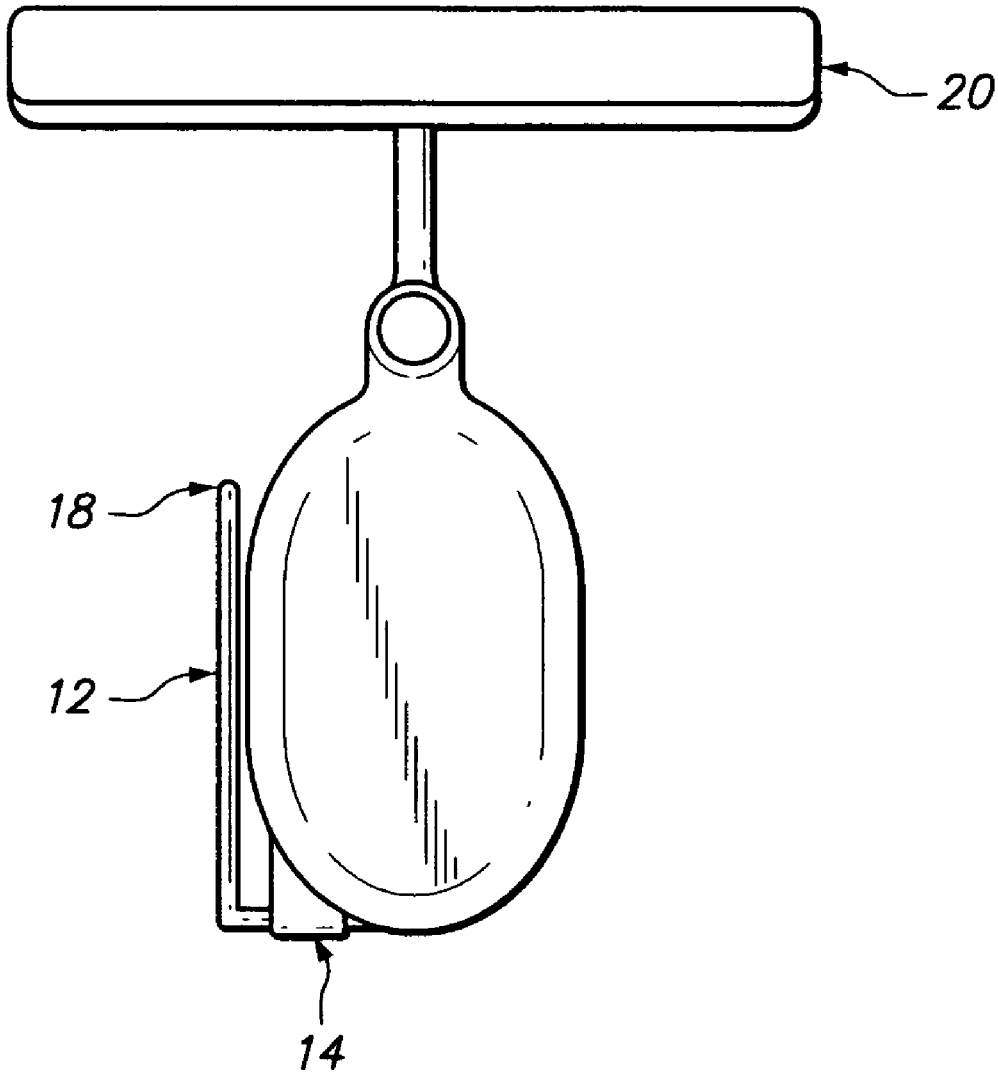
FIG. 4 shows a bottom view of the device.

A molded plastic device to be mounted on extending pole by screwing pole into a threaded hole in the bottom of device (10 in drawing 1/4). The extension poles are commercially available in home improvement stores, painter supply stores and hardware stores. FIG. 1/4 shows side view of device with typical window cleaning fluid spray container bottle in the plastic "basket" wherein the basket defines a receptacle having a bottom wall and a side wall. The basket is designed to accommodate a typical spray bottle, for example 4½"×3½". FIG. 2/4 is a front view showing device without the removable spray bottle. FIG. 3/4 is a view from above without spray bottle. FIG. 4/4 is view from below device without spray bottle. Lever ("12" on all drawings) is angled metal arm having an angled portion hinged to plastic basket at pivot connection 14 to allow the arm to pivot. One end of the pivoting arm holds plastic roller ("16"). Opposite end of arm ("18") has a ring opening to which can be attached a string, plastic line or other line which can be as long as necessary to enable an operator to pull the line regardless of the extent to which the extension pole has been extended, thereby causing the spray bottle to spray its contents. The opposite side of the device is a molded plastic pad ("20") to which can be attached paper towels or other materials to be used to dry the sprayed windows. Paper or other material is attached to the pad by pushing the paper ends into soft plastic slots in the back of the pad ("24" on drawing 2/4). The cleaning/drying pad is attached to the device by a ball-in-socket arm ("22") which allows the pad to swivel.

In use, when a user wishes to employ the device to wash a window, an extending pole may be inserted into threaded hole 10 and a cord or other line may be attached to end 18 of the lever arm 12. A spray bottle is positioned within the basket such that a trigger on the spray bottle is adjacent roller 16. A user may then position the device adjacent a widow and pull the line attached to end 18 of the lever arm 12. Such a movement will cause the lever arm to pivot at the pivot connection 14 to thereby enable roller 16 to depress the trigger and thereby dispense an amount of the contents in the bottle onto a window. The user may then reverse the position of the device with respect to the window to dry the window with the pad 20.

What is claimed is new and is desired to be protected by Letters Patent is set forth in the appended claims:

1. A device for enabling a user to wash and dry a window that is out of reach comprising:

a basket defining a receptacle having a side wall and bottom wall wherein the basket is adapted to hold a removable spray bottle such the spray bottle is able to rest on said bottom wall of said basket in an upright position with said side wall at least partially surrounding the spray bottle;

a mounting hole formed on a bottom portion of said basket; said mounting hole adapted to receive an extension pole;

an lever arm having an angled portion between first and second end portions wherein said angled portion is pivotally mounted to an upper portion of said side wall of said basket at a pivot point on said basket and wherein said first end portion of said lever arm is adapted to be positioned adjacent a trigger on the spray bottle when the spray bottle is placed in said basket;

a pull cord attached to said second end portion of said lever arm;

a pad attached to a rear portion of said basket; said pad adapted to dry a window after contents of the bottle has been sprayed thereon;

whereby when said cord is pulled, said lever arm will pivot about said pivot point for enabling said first end of said lever arm to depress the trigger on the spray bottle to release contents of the spray bottle onto a window to be cleaned.

2. The device as defined in claim 1 and further comprising:

a spray bottle having a trigger thereon positioned in said basket.

3. The device as defined in claim 1 and further comprising:

an extension pole received in said mounting hole.

4. The device as defined in claim 3 wherein said mounting hole is threaded to threadedly receive said extension pole.

5. The device as defined in claim 1 and further comprising:

a roller on said first end of said lever arm for contacting the trigger on the spray bottle.

* * * * *